United States Patent [19]

Herner

[11] Patent Number: 4,607,872

[45] Date of Patent: Aug. 26, 1986

[54] SNOW REMOVING DEVICE

[76] Inventor: Peter L. Herner, R.D. #1, 155 Stephen Park Rd., Hackettstown, N.J. 07040

[21] Appl. No.: 747,776

[22] Filed: Jun. 24, 1985

[51] Int. Cl.[4] ..... E01H 5/02

[52] U.S. Cl. ..... 294/54.5; 37/285

[58] Field of Search ..... 294/54.5, 49, 55, 51, 294/52, 53, 58, 57; 37/264, 265, 130, 134, 284, 122, 285

[56] References Cited

U.S. PATENT DOCUMENTS

| | | | |
|---|---|---|---|
| D. 200,244 | 2/1965 | Yates | D39/1 |
| 967,270 | 8/1910 | Tiedt | 294/54.5 |
| 2,613,977 | 10/1952 | Kellogg | 294/1 |
| 2,891,330 | 5/1959 | Murphy | 37/53 |
| 2,958,143 | 11/1960 | Bonic | 294/54.5 |
| 3,440,741 | 4/1969 | Yates | 37/53 |
| 4,245,411 | 1/1981 | McMath | 37/53 |
| 4,516,799 | 5/1985 | O'Donnell | 294/54.5 |

*Primary Examiner*—James B. Marbert

*Attorney, Agent, or Firm*—Ronald G. Goebel

[57] ABSTRACT

A device for plowing snow is provided by the present invention. The device consists of a sheet material such as a board made of hard but resilient material having a tapered bottom edge and rounded bottom corners. A plurality of slots are located in the top portion of the sheet material and at least one slot is located at each side of the sheet member for grasping the device by hand. Hand grips are located in the top edges and bottom edges of the sheet member adjacent the slots to facilitate grasping and to prevent chafing of the edges of the device against the hands. The tapered bottom edge can be an integral part of the sheet member or an attachment press-fitted on the bottom edge of the device. Optionally a carrying strap may be mounted around the top slots to permit carrying the device to and from its place of storage and during use. A method for plowing snow using the device is also provided wherein the board is held and moved diagonally to the path to be cleared.

3 Claims, 6 Drawing Figures

SNOW REMOVING DEVICE

BACKGROUND OF THE INVENTION

This invention relates to a plow-like snow removing device and a method for clearing snow using such device.

In the past snow has been removed from areas such as driveways and sidewalks by shoveling which involves the accumulation of a mass of snow onto the shoveling device and transporting or throwing it away from the path to be cleared. Alternatively, snow has been removed by moving an ever-increasing mass of snow ahead of the clearing device, e.g. a snow shovel, until the mass of snow offers sufficient resistance to the user to compel the user to stop and move snow away from the path to be cleared. Shoveling or pushing snow along the path to be cleared involves a considerable amount of energy, including bending and strain on the arms and back.

The present invention, on the other hand, provides a device for the hand removal of snow which substantially alleviates the problems associated with shoveling or pushing snow ahead. Instead the device of the invention allows the user to plow snow diagonally to the path of clearing so that the plowed snow moves sideways to the path of clearing. This plow-like method eliminates the bending, lifting and arm use involved in shoveling and reduces the energy required to move snow in the forward direction.

SUMMARY OF THE INVENTION

The invention provides a device for hand plowing snow comprising a sheet member such as a board having a tapered bottom edge which tapered edge can be formed on the sheet member itself or can be in the form of a tapered edge which can be press-fitted on the bottom edge of the sheet member. The top portion of the sheet member is provided with top slots for gripping the device by hand. To prevent chafing of the hand, hand grips may be provided on the top edge of the sheet member adjacent the top slots. The side portions are also provided with side slots for holding the device and hand grips may be mounted on each side edge adjacent a side slot. A carrying handle may be mounted around the top slots for transporting the device to and from its stored position and during use.

In use, the device is held and moved diagonally to the path to be cleared of snow with one hand in a top slot and the other hand in a side slot. Snow is then plowed to the side of the device as it is moved forwardly.

DETAILED DESCRIPTION OF THE PREFERRED EMBODIMENTS

Figure 1:
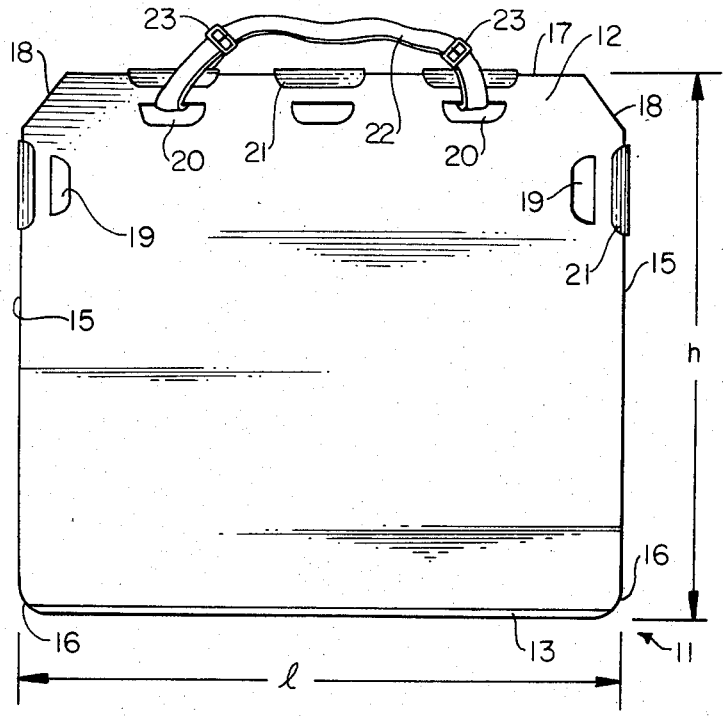
FIG. 1 shows a front view of the snow-removing device of the present invention.
Figure 2:
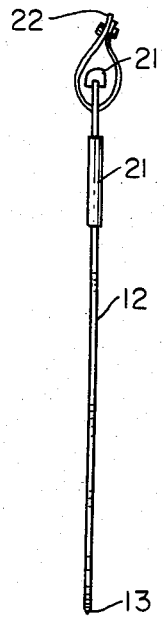
FIG. 2 is a side view of the device.
Figure 5A:
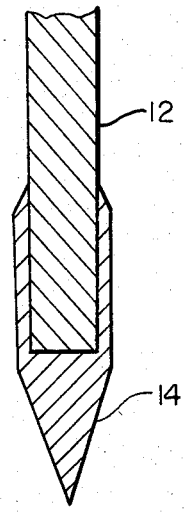
FIGS. 5*a* and 5*b* show two embodiments of a section of the bottom edge of the snow-removing device.
Figure 5B:
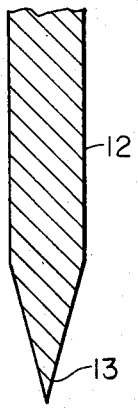

Referring particularly to FIGS. 1 & 2 there is shown a snow-removing device according to the invention shown generally by 11. The device consists of a sheet member e.g. a board 12 comprised of a rigid but flexible material. The board should be sufficiently rigid to move snow in its path but at the same time have the ability to bend inwardly in response to increasing snow load without breaking. It should also have a smooth surface on both sides to minimize adherence of snow thereon during use. Materials such as hardboard, masonite; metals such as aluminum and magnesium, and synthetic or polymeric materials such as fiberglass, polyethylene and the like will suffice. The preferred materials are molded thermoplastic polymeric materials and oil treated hardboard. Preferably the board 12 is four feet in length (l), about 3½ feet in height (h) and about ⅛ inch in thickness. For people 5 feet or less in height, l is preferably 3½ feet and h is preferably 3 feet. However these dimensions may be varied to accomodate the preferences of the user. The bottom edge 13 of the board slides along the surface of an area behind the snow being moved by the device and may be slightly tapered to facilitate such sliding. (See FIG. 5*b*). Alternatively, as shown in FIG. 5*a* the edge can be square and have attached thereto a separate edge member 14 tapered as shown. Such edge member may be made of a hard plastic material such as a high molecular weight polymer, e.g. polyethylene or various metals. The corners 16 of the board between bottom edge 13 and side edges 15 are slightly rounded to enable the user to glide over slight rises in the surface being plowed. It also prevents snagging of the board on surface irregularities such as in clearing wooden decking transversely to the line of boards. The top corners 18 of the board are cut angularly between the top edge 17 and side edges 15. A slot or hand hole 19 is located in the board adjacent each side edge 15. A series of three slots or hand holes 20 are located on the upper portion of the board adjacent and parallel to the top edge 17. Such slots are used for grasping the device during plowing as will be explained in connection with FIG. 3. Hand grips 21 are press-fitted on the side edge and top edge of the board directly across from each slot 19 and 20. These prevent chafing and pressure to the hand when grasping the device through the slots 19 and 20. A carrying strap 22 extends through the outer slots 20 and is fastened thereto through buckles 23. The carrying strap allows the user to transport the board to and from its place of storage and during use as for example from the end of a finished plowed area to the beginning of the next unplowed area.

Figure 3:
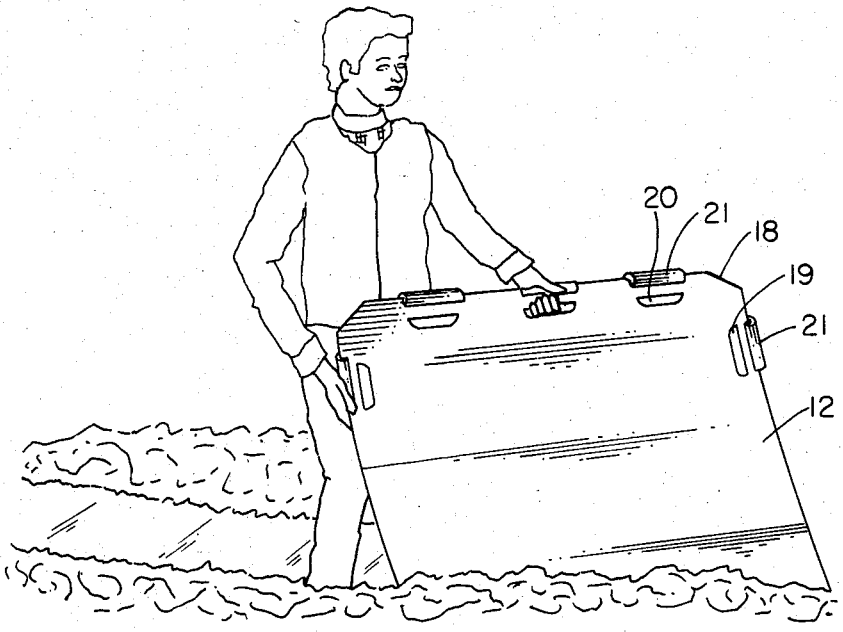
FIG. 3 shows a person using the device to remove snow.

Referring now to FIG. 3 the method of using the device is shown. The device is preferably held by the user by grasping the center slot 20 and hand grip 21 with one hand (in FIG. 3, the left hand) and grasping hand grip 21 adjacent slot 19 with the other (in FIG. 3, the right hand). Alternatively, if desired by the user, the left hand could be moved to any of the other slots 20. The right hand may also be inserted through slot 19. However, it is vital that the device be held and moved diagonally with respect to the path to be cleared. It should also be noted that the user in FIG. 3 is standing upright while using the device. Thus the device eliminates bending and lifting as in shovel devices.

By pushing straight ahead and holding the device diagonally the board acts as a snow plow and deflects the snow to the side instead of building up an increasing mass of snow as would occur if the board were held and moved perpendicularly to the path of clearing. Most of the force required to push the board forwardly is exerted on hand grip 21 adjacent slot 19. Grips 21 adjacent slots 20 are used to guide the device at the angle desired. The angle at which the device is held relative to the path of snow to be cleared depends on the depth of snow and the strength of the user. Generally, the deeper the snow the smaller the angle.

Figure 4:
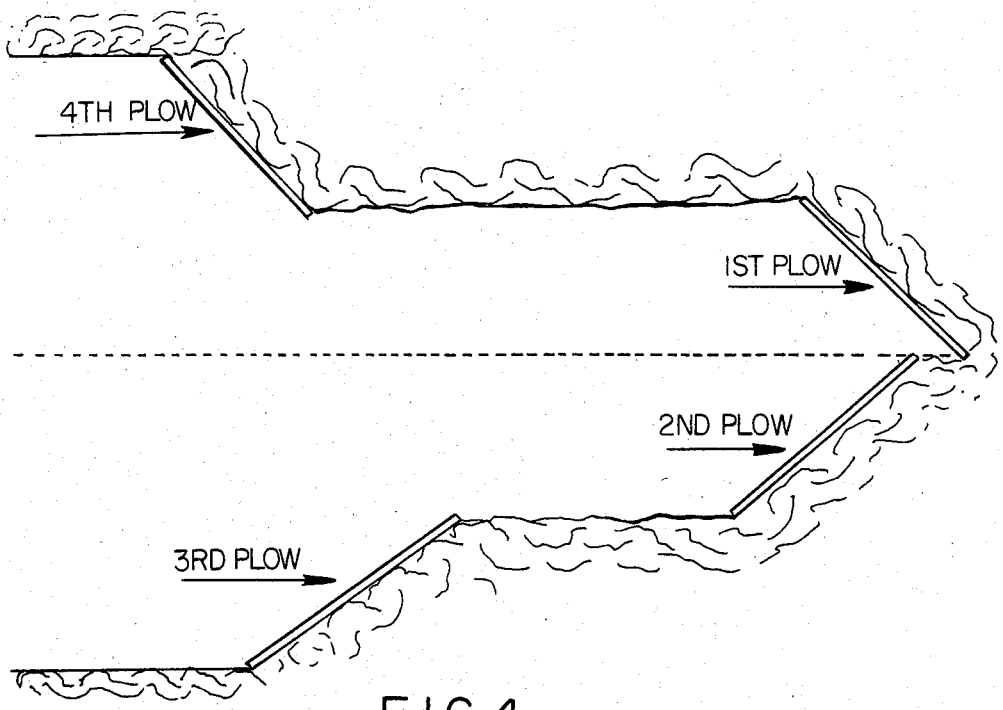
FIG. 4 illustrates a scheme for removing snow from a rectangular area using the device.

FIG. 4 shows a scheme of plowing an area using the board of the invention. The rectangular area in FIG. 4 covered with snow is plowed holding the device diagonally by first plowing a path to the left (top) of the horizontal centerline (dotted lines) of the area (1st plow). Next a second path is made to the right (bottom) of the centerline (2nd plow). Following this a third path is made outward of the 2nd plow (3rd plow). Finally a fourth path is made outward of the 1st plow (4th plow). It was found that by using the above scheme, a driveway measuring 150 feet in length and 10 feet in width was cleared of 4 inches of snow in 7 minutes with the device of the invention.

The board can easily be stored after use on a hook or other fastener on a wall for example.

I claim:

1. A device for hand plowing snow angularly to the path of clearing comprising a rigid but flexible sheet material having a smooth plowing surface and having a width greater than its length, a bottom edge, a top edge, and side edges, and having at least two top slots located in the top portion of said sheet material; at least one side slot located on each side of said sheet material, means to prevent chafing and pressure to the hand located adjacent each said top slots and said side slots, and rounded convex corners between said side edges and said bottom edge;

whereby said device is held angularly to said path of clearing with said bottom edge engaging said path through grasping at a top slot and a side slot and moving said device forwardly to said path.

2. The device of claim 1 wherein said bottom edge is tapered.

3. The device of claim 1 wherein said sheet material further comprises a carrying handle.

* * * * *